US008997981B1

(12) United States Patent
Gilkerson

(10) Patent No.: US 8,997,981 B1
(45) Date of Patent: Apr. 7, 2015

(54) TRIANGULAR GOLF BAG COOLER

(76) Inventor: Daniel E. Gilkerson, Long Beach, CA (US)

( * ) Notice: Subject to any disclaimer, the term of this patent is extended or adjusted under 35 U.S.C. 154(b) by 685 days.

(21) Appl. No.: 13/274,155

(22) Filed: Oct. 14, 2011

(51) Int. Cl.
*F25D 3/08* (2006.01)

(52) U.S. Cl.
CPC ..... *F25D 3/08* (2013.01)

(58) Field of Classification Search
USPC ..... 206/315.5, 545; 62/457.1–457.8
See application file for complete search history.

(56) References Cited

U.S. PATENT DOCUMENTS

| | | | | | |
|---|---|---|---|---|---|
| 4,858,444 | A * | 8/1989 | Scott | 62/372 |
| 4,858,761 | A * | 8/1989 | Fumia | 206/315.3 |
| 5,071,046 | A * | 12/1991 | Miller | 224/585 |
| 5,222,598 | A * | 6/1993 | Yamazoe | 206/315.5 |
| 5,301,519 | A | 4/1994 | Howorka | |
| 5,490,396 | A * | 2/1996 | Morris | 62/457.2 |
| 5,640,855 | A | 6/1997 | Crescenzo et al. | |
| 5,722,253 | A * | 3/1998 | Todd | 62/457.5 |
| 5,769,219 | A | 6/1998 | Shimel | |
| 5,915,551 | A | 6/1999 | Vavro | |
| 6,336,577 | B1 * | 1/2002 | Harris et al. | 224/153 |
| 6,394,325 | B1 * | 5/2002 | Taylor | 224/274 |
| 2005/0103043 | A1 * | 5/2005 | McCrory | 62/457.2 |

* cited by examiner

*Primary Examiner* — Tri Mai
(74) *Attorney, Agent, or Firm* — Crossley Patent Law

(57) ABSTRACT

A triangular golf bag cooler that includes a triangular longitudinal cross-section configured to fit the cooler within an extant golf bag pocket; the triangular golf bag cooler having a gel layer disposed between an outer liner and an interior liner; said gel layer freezable with a high specific heat capacity to provide extended cooling to items stored within an interior cavity; a drain plug disposed in a first side to drain condensation and melt water from the interior cavity; the triangular golf bag cooler collapsible when empty for easy portage and storage; to provide ready access to food items proximal to the golfer's clubs when playing on a fairway.

6 Claims, 5 Drawing Sheets

TRIANGULAR GOLF BAG COOLER

BACKGROUND OF THE INVENTION

Various types of golf bag coolers are known in the prior art. However, what is needed is a triangular golf bag cooler that includes a triangular longitudinal cross-section configured to fit the triangular golf bag cooler within an extant golf bag pocket, the triangular golf bag cooler having a gel layer disposed between an outer liner and an interior liner; said gel layer freezable with a high specific heat capacity to provide extended cooling to items stored within an interior cavity; a drain plug disposed in a first side to drain condensation and melt water from the interior cavity, the triangular golf bag cooler collapsible when empty for easy portage and storage, to provide ready access to food items proximal to the golfer's clubs when playing on a fairway.

FIELD OF THE INVENTION

The present invention relates to a triangular golf bag cooler, and more particularly, to a triangular golf bag cooler that includes a triangular longitudinal cross-section configured to fit the triangular golf bag cooler within an extant golf bag pocket; the triangular golf bag cooler having a gel layer disposed between an outer liner and an interior liner; said gel layer freezable with a high specific heat capacity to provide extended cooling to items stored within an interior cavity; a drain plug disposed in a first side to drain condensation and melt water from the interior cavity; the triangular golf bag cooler collapsible when empty for easy portage and storage; to provide ready access to food items proximal to the golfer's clubs when playing on a fairway.

SUMMARY OF THE INVENTION

The general purpose of the triangular golf bag cooler, described subsequently in greater detail, is to provide a triangular golf bag cooler which has many novel features that result in a triangular golf bag cooler which is not anticipated, rendered obvious, suggested, or even implied by prior art, either alone or in combination thereof.

Golfing is a sport best enjoyed in clement, sunny weather. Being predominantly a summer sport, many golfers enjoy cooled beverages as they make their way across the fairway. While other coolers devised for golfers are seen in the prior art, they are typically devised as part of a specific golf bag itself, or alternately attach to the exterior of a golf bag. What is preferable is a golf bag cooler devised to conveniently fit into an extant golf bag pocket for use with preexisting golf bags typical to many golfers.

The present triangular golf bag cooler, therefore, is configured to fit into an extant golf bag pocket. The present golf bag cooler has a triangular longitudinal cross section configured to fit within said extant pocket, and includes a generally rectangular base, a generally rectangular rear side disposed endwise perpendicularly from the base, and a sloped side disposed between the base and the rear side. A triangular first side is disposed laterally between the base, the rear side, and the sloped side, and a triangular second side is disposed parallel the first side.

A durable, impermeable outer layer is suffusively disposed across the base, rear side, sloped side, first side and second side. Immediately disposed beneath this outer layer is an insulated outer liner. Disposed parallel to the outer liner, and surrounding an interior cavity, is suffusively disposed an impermeable interior liner. An insulating gel layer is disposed between the outer liner and the interior liner. This gel layer has a high specific heat capacity and solidifies when frozen to engender an extended cooling capacity to items placed within the interior cavity. The gel layer may be conveniently frozen by placing the present triangular golf bag cooler in an extant household freezer. Thusly, the outer liner insulates and the gel layer cools the interior cavity.

A plastic seal is disposed within the sloped side. The seal includes a first seam member, a second seam member, and a zip member. The first and second seam members are disposed in parallel, and the zip member releasably engages the first seam member with the second seam member when the zip member is moved between a sealed position and an open position. When the zip member is moved to the sealed position, the seal is impermeable. When the zip member is moved to the open position, the first seam member disengages from the second seam member and an aperture is opened therebetween. The interior cavity is thusly accessible through the aperture when the zip member is moved to the open position, and items (including soda cans, ice, and other foodstuffs) may be placed within, and alternately retrieved from, the interior cavity.

To prevent mildewing of the triangular golf bag cooler and to remove melt water therefrom, a drain plug is disposed in the first side proximal to the base, the drain plug interconnected to the interior cavity. This drain plug includes an extendible tubular member, an outward end, and a removable plug disposed within the outward end. The drain plug is extendible perpendicularly out from the first side, and any fluids resulting from condensation may be drained out from the interior cavity by means of the drain plug, the impermeable interior liner and the seal otherwise preventing said fluids from draining from the device.

Another feature of the device is collapsibility. When the interior cavity is empty, the device may be collapsed along a plurality of folds for ease of portage and efficiency of storage. When collapsed, the first side is moved proximal to the second side, and the base, the rear side, and the sloped side are collapsed along the plurality of folds. When extended for use, the first side is moved away from the second side, and the base, the rear side, and the sloped side, are reconfigured as rectangular surfaces disposed between the first and second sides.

The present triangular golf bag cooler is envisioned to be available in a number of sizes with dimensions configured to fit in an extant golf bag exterior pocket and alternately within an extant golf bag interior pocket. Each embodiment is merely sized appropriate to a specific pocket, and the dimensions should not be considered to limit the device as the concept, design, and usages of each embodiments are essentially the same. Furthermore, designs and logos are envisioned across the outer layer, as may be desired.

Thus has been broadly outlined the more important features of the present triangular golf bag cooler so that the detailed description thereof that follows may be better understood and in order that the present contribution to the art may be better appreciated.

Objects of the present triangular golf bag cooler, along with various novel features that characterize the invention are particularly pointed out in the claims forming a part of this disclosure. For better understanding of the triangular golf bag cooler, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
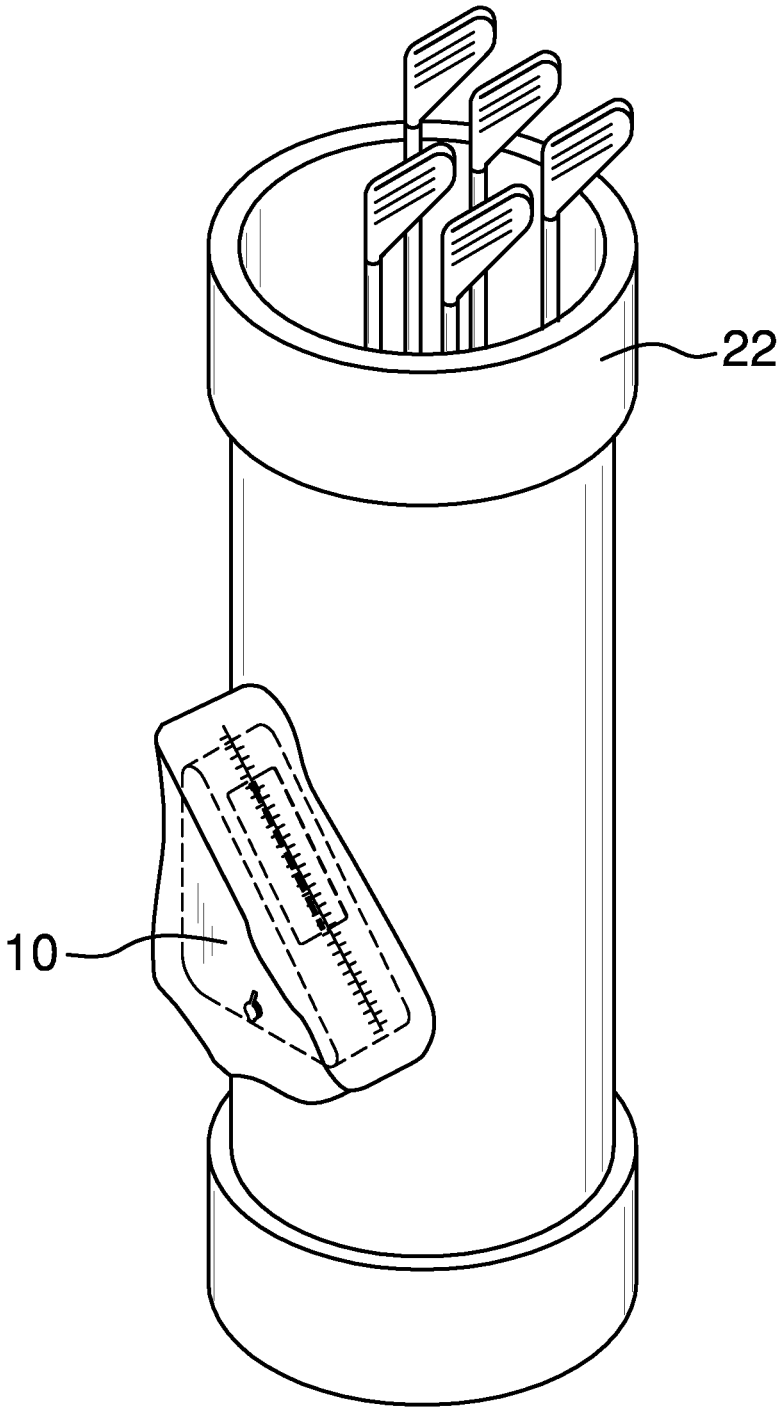
FIG. 1 is an isometric view illustrating the device disposed within an extant golf bag exterior pocket.
Figure 2:
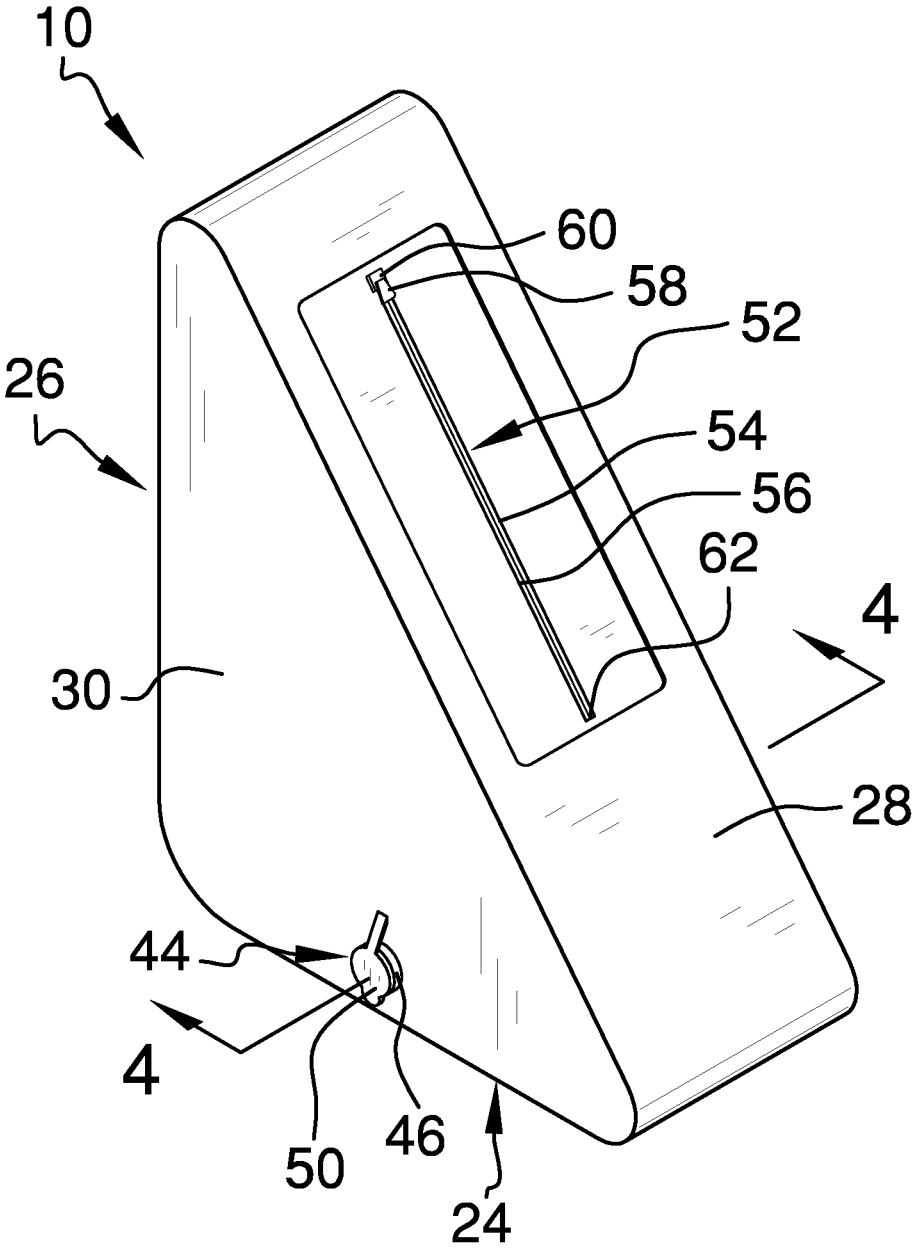
FIG. 2 is an isometric view with a plastic seal in a sealed position.
Figure 3:
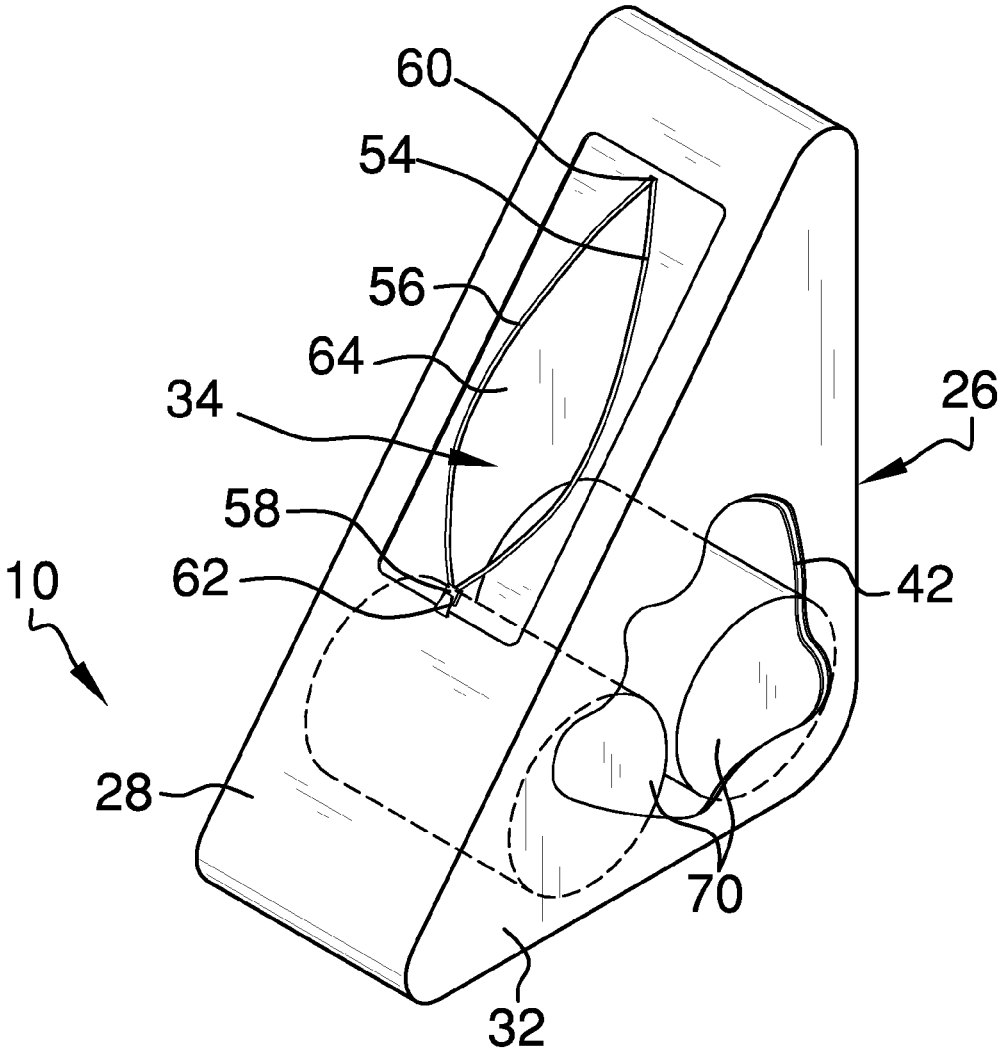
FIG. 3 is an isometric view illustrating an interior cavity with the plastic seal in an open position.
Figure 4:
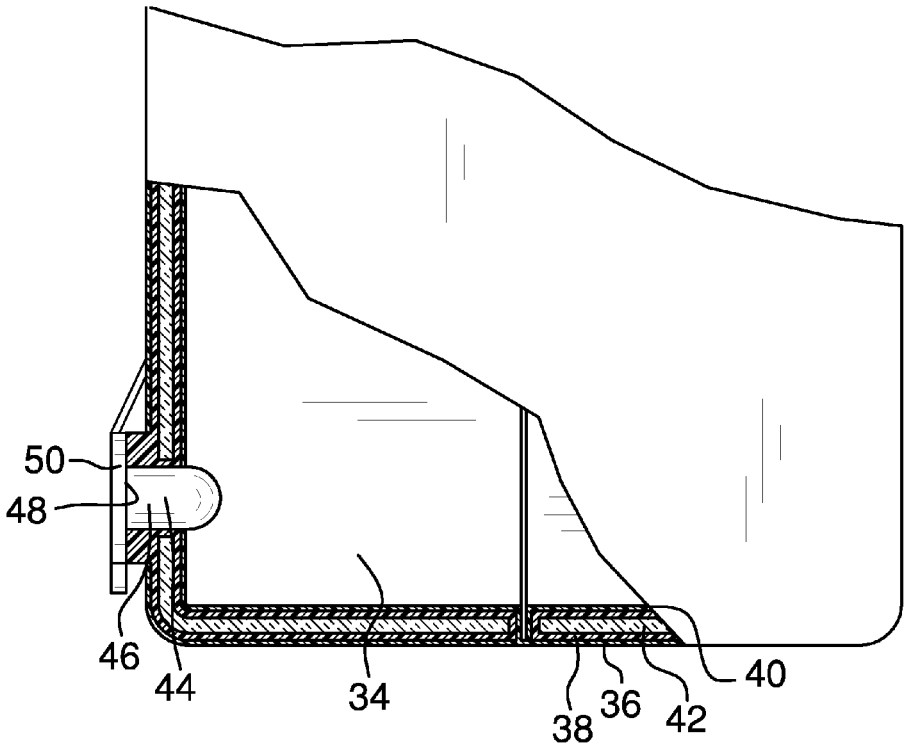
FIG. 4 is a cross-section view taken along the line 4-4 of FIG. 2.
Figure 5:
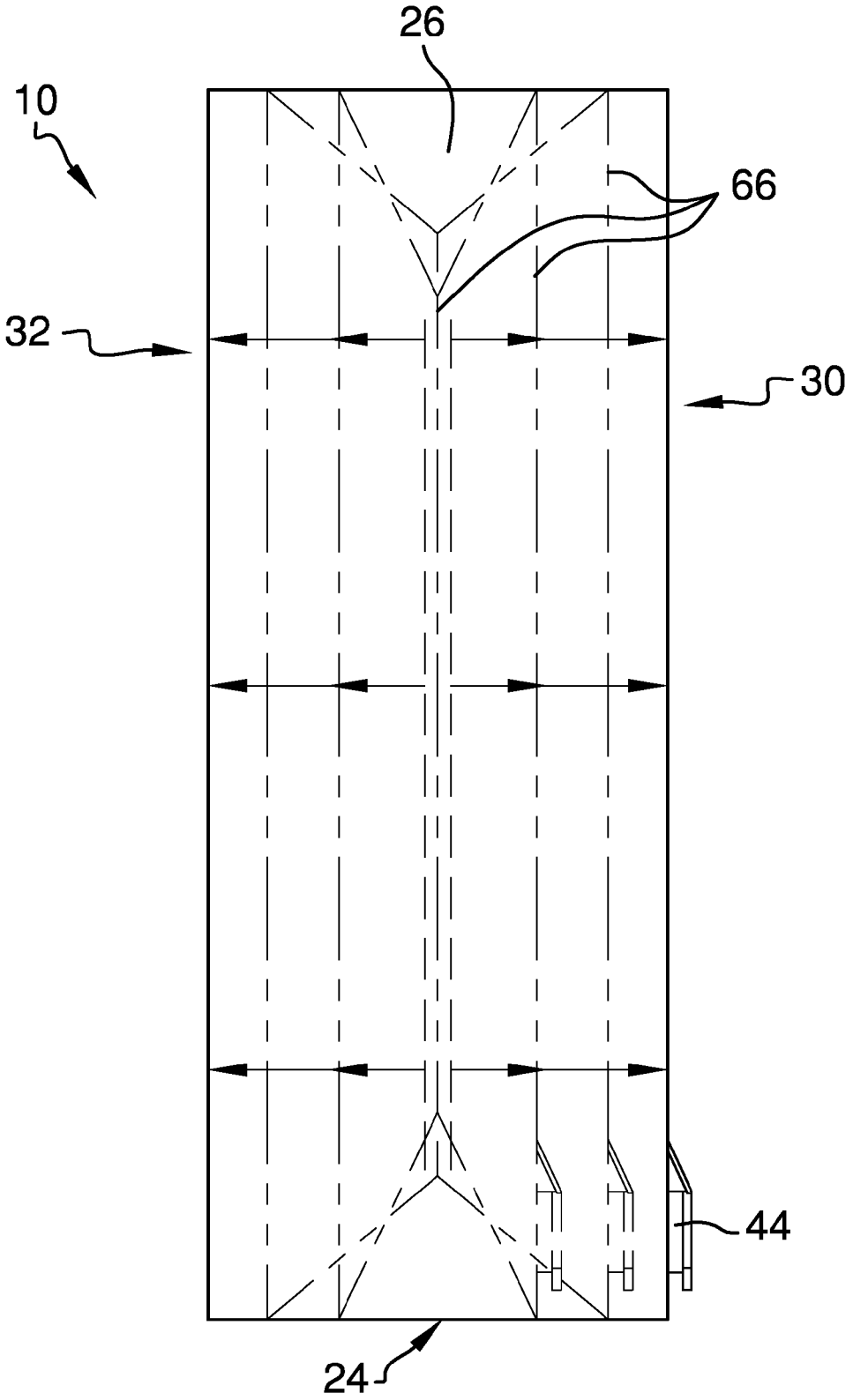
FIG. 5 is a rear view.

With reference now to the drawings, and in particular FIGS. 1 through 5 thereof, example of the instant triangular golf bag cooler employing the principles and concepts of the present triangular golf bag cooler and generally designated by the reference number 10 will be described.

Referring to FIGS. 1 through 5 a preferred embodiment of the present triangular golf bag cooler 10 is illustrated.

The present triangular golf bag cooler 10 is configured to fit into an extant pocket 20 disposed on an extant golf bag 22 to portably cool items 70 stored therein without leaking condensation or melt water into the golf bag 22.

The present triangular golf bag cooler 10 is configured to fit into an external pocket of an extant golf bag 22 to be carried onto a golf course alongside a set of clubs whenever a golfer is so engaged with his/her sport. An alternative embodiment of the present triangular golf bag cooler 10 is identical with the former, excepting dimensions configured to fit within an interior pocket of an extant golf bag 22, as will be detailed further in this specification. The dimensions of either embodiment, therefore, should not be considered as limiting the device 10: the important features and several usages of the device 10 are disclosed below, said features and usages consistent to both envisioned embodiments of the device 10. The purpose of the alternative embodiment is to offer golfers an additional triangular golf bag cooler 10 configured to fit within an extant golf bag 22 pocket 20, as may be desired. However, the fundamental concept of the device 10 remains constant.

The triangular golf bag cooler 10 has a triangular longitudinal cross section and includes a rectangular base 24, a rectangular rear side 26 disposed endwise perpendicularly from the base 24, and a rectangular sloped side 28 disposed diagonally between the base 24 and the rear side 26. A triangular first side 30 is laterally disposed between the base 24, the rear side 26, and the sloped side 28. A triangular second side 32 is laterally disposed opposite to and parallel with the first side 30. An interior cavity 34 is disposed between the base 24, the rear side 26, the sloped side 28, the first side 30, and the second side 32.

An impermeable outer layer 36 is disposed suffusively upon the base 24, the rear side 26, the sloped side 28, the first side 30, and the second side 32. This outer layer 36 is configured to be durable. An insulating outer liner 38 is disposed suffusively beneath the outer layer 36 to inhibit the transmission of heat into the interior cavity 34 from the ambient temperature. An impermeable interior liner 40 is further disposed within the interior cavity 34 parallel the outer liner 38, the interior liner 40 disposed suffusively upon the base 24, the rear side 26, the sloped side 28, the first side 30, and the second side 32, the interior liner 40 enclosing the interior cavity 34.

An insulating gel layer 42 is disposed between the outer liner 38 and the interior liner 40. The gel layer 42 includes a freezable gel having a high specific heat capacity. The gel layer 42 solidifies when frozen and provides extended cooling capacity to items placed in the interior cavity 34. Thusly, the interior cavity 34 is insulated by the outer liner 38 and the gel layer 42 cools items placed therein.

A drain plug 44 is centrally disposed on the first side 30 proximal the base 24, the drain plug 44 interconnecting with the interior cavity 34. The drain plug 44 is recessed within the first side 30. The drain plug 44 includes an extendible tubular member 46, an outward end 48 disposed on the tubular member 46, and a removable plug 50 disposed within the outward end 48. The drain plug 44 is configured to be extended perpendicularly out from the first side 30 when needed, and fluids may be drained from the interior cavity 34 when the removable plug 50 is removed from the outward end 48. Any condensation, melt water, or other fluids resulting from items 70 stored in the present triangular golf bag cooler 10, including ice added for additional cooling, may therefore be readily drained from within the interior cavity 34 by means of the drain plug 44 to stop mildewing or molding of the interior cavity 34. The impermeable inner liner 40 otherwise prevents liquids from draining out of the triangular golf bag cooler 10, preventing seepage into the extant golf bag 22.

A plastic seal 52 is disposed upon the sloped side 28. The plastic seal 52 includes a plastic first seam member 54, a plastic second seam member 56, and a slidable zip member 58. The first seam member 54 and the second seam member 56 are disposed in parallel. The slidable zip member 58 is configured to releasably engage and seal the first seam member 54 with the second seam member 56, the zip member 58 moving between a sealed position—with the zip member 58 disposed at a first end 60 of the seal 52—and an open position, with the zip member 58 disposed at a second end 62 of the seal 52. When the zip member 58 is moved to the open position, the interior cavity 34 is accessible through an aperture 64 opened between the first seam member 54 and the second seam member 56, and items 70 (such as soda cans or food items) may be stored and cooled therein. When the zip member 58 is moved to the sealed position, the first seam member 54 engages with the second seam member 56 and the aperture 64 is sealingly closed.

The present golf bag cooler 10 is further configured to be collapsible for easy storage and portability. The present golf bag cooler 10 is configured to be collapsible along a plurality of folds 66 disposed between the first 30 and second 32 sides. When moved to a collapsed position, the first side 30 and the second side 32 are positioned proximal to one another. When moved to an extended position, the first side 30 and the second side 32 are moved apart, the base 24, rear side 26, and the sloped side 28 flatten, the plurality of folds 66 opening.

When the present triangular golf bag cooler 10 is configured to fit in the external pocket of an extant golf bag 22, the base 24 is approximately 6 inches in length, the rear side 26 is approximately 8 inches in length, the sloped side 28 is approximately 11 inches in length, and the seal is approximately 7 inches in length. When configured to fit within an internal pocket of an extant golf bag 22, the triangular golf bag cooler 10 base 24 is approximately 10 inches in length, the rear side 26 is approximately 12 inches in length, and the sloped side 28 is approximately 15 inches in length. The seal is then approximately 11 inches in length.

What is claimed is:

1. A triangular golf bag cooler having a triangular longitudinal cross section, the triangular golf bag cooler comprising:

a rectangular base;

a rectangular rear side disposed endwise perpendicularly from the base;

a rectangular sloped side disposed diagonally between the base and the rear side;

a triangular first side laterally disposed between the base, the rear side, and the sloped side;

a triangular second side laterally disposed opposite to and parallel with the first side;

an interior cavity disposed between the base, the rear side, the sloped side, the first side, and the second side;

an impermeable outer layer suffusively disposed upon the base, the rear side, the sloped side, the first side, and the second side;

an insulating outer liner suffusively disposed beneath the outer layer;

a drain plug centrally disposed on the first side proximal to the base, the drain plug interconnecting with the interior cavity;

an impermeable interior liner suffusively disposed within the interior cavity, the interior liner disposed upon the base, the rear side, the sloped side, the first side, and the second side, enclosing the interior cavity;

an insulating gel layer disposed between the outer liner and the interior liner;

a plastic seal disposed upon the sloped side, the seal comprising:

a first seam member;

a second seam member disposed parallel with the first seam member;

a slidable zip member configured to releasably engage and slidingly seal the first seam member with the second seam member, the zip member moving between a sealed position and an open position;

wherein the triangular golf bag cooler is configured to fit within an extant pocket disposed on an extant golf bag and the gel layer is freezable, whereby the gel layer provides extended cooling capacity for items stored within the golf bag cooler and the triangular golf bag cooler is readily carried within the extant golf bag;

wherein the drain plug is recessed within the first side, the drain plug comprising:

an extendible tubular member;

an outward end disposed on the tubular member;

a removable plug disposed within the outward end;

wherein the drain plug may be extended from the first side, and fluids drained from the interior when the removable plug is removed;

a plurality of folds disposed upon each of the base, the rear side, and the sloped side;

wherein the base, the rear side, and the sloped side are collapsible when the cooler is empty, whereby the first side and the second side are positional proximal to one another, for efficient portage and storage.

2. The triangular golf bag cooler of claim 1 configured to fit into a pocket of an extant golf bag.

3. The triangular golf bag cooler of claim 2 wherein the base is approximately 6 inches in length, the rear side approximately 8 inches in length, and the sloped side approximately 11 inches in length.

4. The triangular golf bag cooler of claim 2 wherein the base is approximately 10 inches in length, the rear side approximately 12 inches in length, and the sloped side approximately 15 inches in length.

5. The triangular golf bag cooler of claim 3 wherein the plastic seal is approximately 7 inches in length.

6. The triangular golf bag cooler of claim 4 wherein the plastic seal is approximately 11 inches in length.

* * * * *